US007140803B2

(12) United States Patent
Cummings et al.

(10) Patent No.: US 7,140,803 B2
(45) Date of Patent: Nov. 28, 2006

(54) PASSIVE TRAFFIC LANE MARKING FOR ON-BOARD DETECTION OF LANE BOUNDARY

(76) Inventors: Richard Cummings, 625 Marshall Rd., Coldwater, MI (US) 49036; Aaron Cummings, 515 W. Colon Rd., Coldwater, MI (US) 49036

( * ) Notice: Subject to any disclaimer, the term of this patent is extended or adjusted under 35 U.S.C. 154(b) by 116 days.

(21) Appl. No.: 11/055,502

(22) Filed: Feb. 10, 2005

(65) Prior Publication Data

US 2006/0177265 A1 Aug. 10, 2006

(51) Int. Cl.
*E01F 9/04* (2006.01)
*G01S 13/00* (2006.01)

(52) U.S. Cl. ..... 404/12; 404/14; 404/94; 342/70

(58) Field of Classification Search ..... 404/12–16, 404/93, 94; 342/70
See application file for complete search history.

(56) References Cited

U.S. PATENT DOCUMENTS 4,361,202 A * 11/1982 Minovitch ..... 180/168
5,347,456 A 9/1994 Zhang et al.
5,663,548 A 9/1997 Hayashi et al.
6,370,474 B1 4/2002 Hiwatashi et al.
6,370,475 B1 4/2002 Breed et al.
6,411,901 B1 6/2002 Hiwatashi et al.
6,414,606 B1 7/2002 Yujiri et al.
6,417,785 B1 7/2002 Tyburski
6,502,031 B1 12/2002 Uehara
6,614,469 B1 9/2003 Kato et al.
6,753,902 B1 6/2004 Kashiwazaki
2005/0238425 A1 * 10/2005 Safar ..... 404/16

* cited by examiner

*Primary Examiner*—Raymond W. Addie
(74) *Attorney, Agent, or Firm*—George L. Boller

(57) ABSTRACT

A system and process for detecting a traffic lane boundary before it is potentially violated by a moving vehicle traveling in the lane. Passive RF tags or labels are embedded in a paint stripe running along pavement. A sensor in the vehicle emits an RF signal at a frequency to which the tags or labels are responsive. When the emitted signal is incident on a tag or label with strength indicative of straying of the vehicle from the lane toward incipient violation of the lane boundary defined by the stripe, the tag or label issues a return signal that is received by the sensor for on-board signaling of the potential violation to alter the driver so that corrective action can be taken.

9 Claims, 1 Drawing Sheet

PASSIVE TRAFFIC LANE MARKING FOR ON-BOARD DETECTION OF LANE BOUNDARY

FIELD OF THE INVENTION

This invention relates to a passive traffic lane marking system that enables a motor vehicle having on-board sensors at either side near the front to detect potentially incipient violation of traffic lane boundaries defined by paint stripes containing embedded passive elements, commonly referred to as tags or labels, and upon detection to alert the driver so that corrective action can be taken to avoid lane boundary violation.

BACKGROUND OF THE INVENTION

Various types of traffic lane marking systems are shown in different U.S. Patents. Some use active markers, meaning markers that emit a signal of some sort, while others use passive ones.

For example, U.S. Pat. No. 5,347,456 describes a system of passive markers that are placed along a centerline of a traffic lane and contain coded information that can be read by a vehicle traveling over them.

Other types use on-board cameras and imaging techniques to acquire roadway information, process the acquired information, and then relate the vehicle to the processed roadway information. Those types of systems would seem to be quite complex and very expensive for widespread use in mass-produced motor vehicles, especially if the information must be acquired and processed in real time. U.S. Pat. Nos. 6,614,469 and 6,411,901 are examples of such systems.

Still another patented system uses GPS to relate a traveling vehicle to stored data defining lane boundaries.

U.S. Pat. No. 6,502,031 proposes the use of magnetic markers in a roadway for detection by suitable on-board equipment.

U.S. Pat. No. 6,414,606 proposes the addition of metallic shot or particles of other materials having a high dielectric constant to a thermoplastic paint used to paint lane stripes on pavement. A vehicle containing suitable detection equipment can detect the additive material in the painted stripes.

SUMMARY OF THE INVENTION

The present invention relates to a system and process for placement of passive markers on pavement to define traffic lane boundaries and enable a vehicle having proper detection equipment and traveling in the lane to detect the lane boundary before it is potentially violated by the moving vehicle.

The invention is capable of providing advantages that will allow economical placement installation of passive markers on roadway surfaces, reasonable durability and life of the markers, and consequently enable economical detection systems to be used in motor vehicles.

Briefly the invention contemplates the use of wafer-thin elements embedded in painted traffic lane stripes such that the cured paint both separates the bottom faces of the elements from the pavement and covers the top faces of the elements. These elements utilize the same technology as used commercially in store anti-theft systems, pet identification systems, and PASS highway toll systems, and can be economically fabricated in mass-produced quantities. These elements are commonly referred to as tags or labels.

On-board sensing devices are installed in motor vehicles, one on each side near the front, such as in front of each front tire at the bottom of the front bumper. The aiming of each sensing device is down and slightly outboard. Each sensing device incorporates both a transmitter and receiver. Sometimes both the transmitter and receiver are combined in one antenna frame.

The wafer-thin tags or labels, which are basically miniature, disposable electronic circuits with antennas, are embedded in the paint stripes. Each tag or label responds to a radio signal of specific frequency and sufficient strength by returning a return signal. Each sensor in a vehicle emits a radio signal of predetermined frequency and strength. When such a signal is incident on an embedded tag or label, and the received strength is sufficient to cause the tag or label to issue a return signal, the return signal is picked up by the sensor receiver. Operating frequencies for RF systems generally range from 2 to 10 MHz (millions of cycles per second).

The passive elements in the painted lane stripes are coded to respond to different frequencies based on the location of the particular stripe so that an on-board processor used for detection will be able to distinguish individual stripes on a roadway, such as distinguishing a centerline stripe that separates oncoming lanes from a shoulder stripe.

When a vehicle is too close to, or actually crosses, a lane stripe, the processor detects the embedded passive elements and alerts the vehicle driver both visually, such as by flashing light, and audibly, such as by audio message. To keep the alert from coming on during turns, lane changes, and passing, the turn signals provide an input to the processor such that if the lane change/turn signal is ON, the alert is disabled.

It is believed that widespread adoption of this system can provide a significant reduction in traffic accidents.

DESCRIPTION OF THE INVENTION

Figure 1:
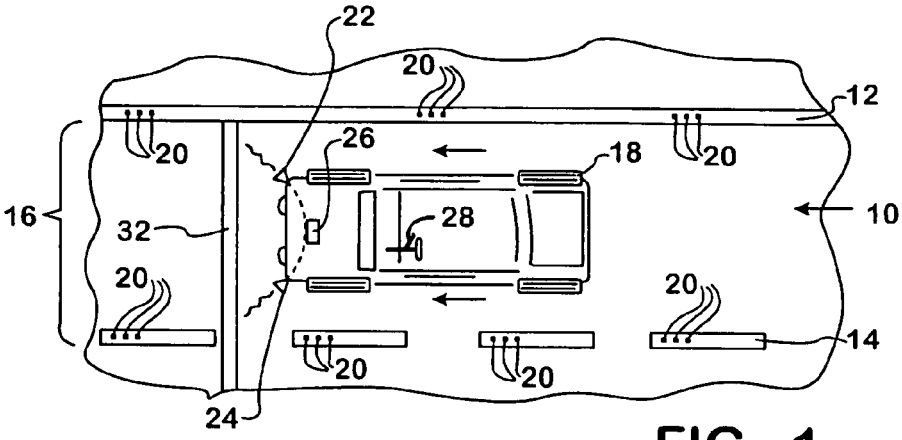
FIG. 1 is a plan view of a roadway showing a single traffic lane with a motor vehicle traveling in the lane, including a representation of on-board sensors and a processor.
Figure 2:
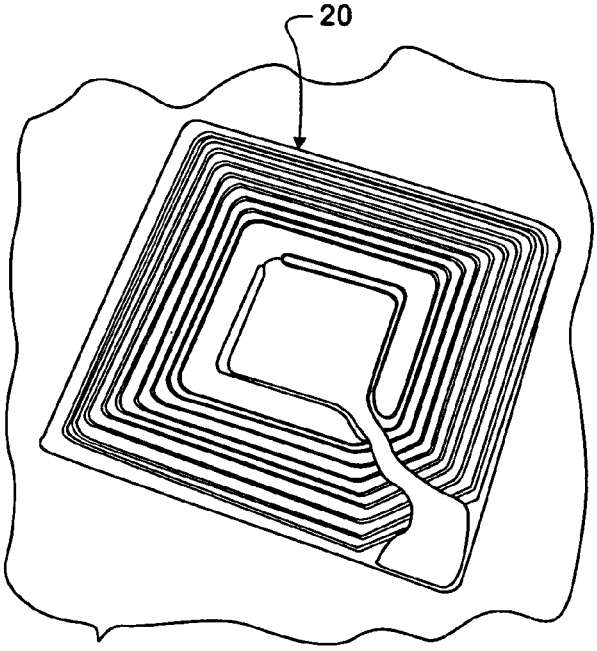
FIG. 2 is a plan view representative of passive elements that are embedded in lane stripes.

FIG. 1 shows a roadway 10 with painted stripes 12 and 14 defining a single travel lane 16. A motor vehicle 18 is shown traveling in lane 16. Each stripe 12, 14 may be continuous or interrupted. Embedded within the painted stripes are tags or labels 20, such as the one shown in FIG. 2.

Each tag 20 comprises a helical antenna etched from thin aluminum bonded to a piece of paper. At the end of the antenna is a small diode or RC network that causes the tag to emit an RF signal in response to an RF signal it receives.

Vehicle 18 has sensors 22, 24 installed as described above. A processor 26 is associated with the sensors. Each sensor emits an RF signal at a different frequency. The tags in stripe 12 are tuned to the frequency of sensor 22 while the tags in stripe 14 are tuned to the frequency of sensor 24.

Figure 3:
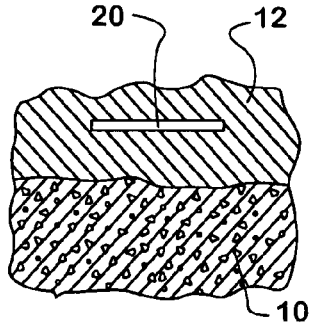
FIG. 3 is a cross section view showing an embedded element in a paint stripe.

FIG. 3 shows how a tag is embedded in a paint stripe such that the cured paint both separates the bottom face of the tag from pavement and covers the top face of the tag. Such that the RE tag or label is suspended within the paint medium.

As vehicle 18 is traveling, sensors 22, 24 are emitting low-power RF signals. As long as the vehicle remains within the lane sufficiently distant from the two stripes on either side, the tags in the stripes will not return signals that can be detected by the sensors. But if the vehicle strays to one side, the corresponding sensor will begin to the receive a return signal from the stripe toward which the vehicle is straying. The on-board system will then issue an alter to the driver.

To keep the alert from coming on during turns, lane changes, and passing, the turn signals 28 provide an input to processor 26 such that if the lane change/turn signal is ON, the alert is disabled.

Certain tags may have different return signal capabilities, such as the ability to return a signal at a frequency other than the frequency of the signal it receives, the ability to return signals at different frequencies, and the ability to return a coded signal providing information other than the mere fact that it has received a signal. Hence a sensor and processor in a vehicle must have corresponding capabilities to handle such returns and extract and process whatever information is in them for use by the driver.

Principles of the invention extend to tags that are placed on roadways other than in lane-defining stripes. For example, placement of tags on a roadway in a stripe that is transverse to the direction of vehicle travel may serve to alert a driver to an imminent change in the roadway, such as an upcoming curve. The transverse stripe contains multiple tags at intervals across the lane such that either one or both sensors will detect them and recognize them as different from stripes that run along the length of the roadway. The processing can provide a corresponding alert, possibly one that is different from an alert indicating a potential lane violation. An example of such a transverse stripe 32 is shown in FIG. 1.

In all instances where tags are embedded in paint, the paint must not contain material that would seriously degrade RF transmission through it.

While a presently preferred embodiment of the invention has been illustrated and described, it should be appreciated that principles of the invention apply to all embodiments falling within the scope of the following claims.

What is claimed is:

1. A pavement marking system comprising a painted stripe running along pavement and passive RF tags or labels suspended in the paint at intervals along the length of the stripe the RF tags or labels having a helical antenna etched from a thin metal conductor bonded to a substrate, wherein the antenna causes the tag to emit an RF signal in response to a 1$^{st}$ RF signal the tag or label receives, the emitted signal being indicative of the presence of the painted stripe.

2. A pavement marking system as set forth in claim 1 wherein the stripe is a lane marking stripe running in the direction of a travel lane.

3. A pavement marking system as set forth in claim 1 wherein the stripe is transverse to the direction of a travel lane.

4. A system for enabling a vehicle moving along a roadway to detect a roadway condition, the system comprising passive RF tags or labels embedded in a paint stripe on roadway pavement and a sensor in the moving vehicle for emitting an RF signal at a frequency to which the tags or labels are responsive such that when the emitted signal is incident on a tag or label with sufficient strength, the tag or label issues a return signal that is received by the sensor for on-board signaling of the presence of the stripe.

5. A system as set forth in claim 4 in which the stripe is arranged to define a traffic lane boundary and the sensor is arranged to emit the RF signal such that when the emitted signal is incident on a tag or label with strength sufficient to cause the tag or label to issue a return signal that can be received by the sensor for on-board signaling of the presence of the stripe, indicating the vehicle is approaching incipient violation of the lane stripe.

6. A system as set forth in claim 5 in which there are two such stripes running along opposite sides of the lane and two such sensors, one on either side of the vehicle for detecting an incipient violation of either stripe by the vehicle.

7. A system as set forth in claim 4 in which the stripe runs transverse to the lane.

8. A method for enabling a vehicle moving along a roadway to detect a roadway condition, the method comprising embedding passive RF tags or labels in a roadway paint stripe, and in a moving vehicle, emitting an RF signal at a frequency to which the tags or labels are responsive such that when the emitted signal is incident on a tag or label with sufficient strength, the tag or label issues a return signal, receiving the return signal at the sensor, and processing the received return signal in an on-board processor to signal the presence of the stripe.

9. A method as set forth in claim 8 including alerting a driver of the vehicle when the processing signals the presence of the stripe.

* * * * *